United States Patent [19]

Riehl

[11] Patent Number: 4,541,797

[45] **Date of Patent: * Sep. 17, 1985**

[54] FUEL CONTROL SYSTEM HAVING AN ELECTRICAL IGNITION PROBE, PARTS THEREFOR AND METHODS OF MAKING THE SAME

[75] Inventor: Fred Riehl, Greensburg, Pa.

[73] Assignee: Robertshaw Controls Company, Richmond, Va.

[ * ] Notice: The portion of the term of this patent subsequent to Aug. 21, 2001 has been disclaimed.

[21] Appl. No.: 617,903

[22] Filed: Jun. 6, 1984

Related U.S. Application Data

[60] Division of Ser. No. 545,668, Oct. 26, 1983, Pat. No. 4,466,789, which is a continuation of Ser. No. 318,025, Nov. 4, 1981, abandoned.

[51] Int. Cl.[4] ..... F23Q 3/00

[52] U.S. Cl. ..... 431/264

[58] Field of Search ..... 431/264, 265, 78, 80, 431/25, 59

[56] References Cited

U.S. PATENT DOCUMENTS

| | | | |
|---|---|---|---|
| 961,681 | 6/1910 | Cole | 361/253 |
| 983,489 | 2/1911 | Fullenweider | 361/253 |
| 1,774,846 | 9/1930 | Rosenberg | 411/451 |
| 2,096,945 | 10/1937 | Van Law | 431/264 |
| 2,231,347 | 2/1941 | Reutter | 411/456 |
| 2,311,601 | 2/1943 | Slaght | 431/264 |
| 2,545,945 | 3/1951 | Ensign et al. | 431/266 |
| 3,352,191 | 11/1967 | Crawford | 411/456 |
| 3,386,431 | 6/1968 | Branson | 239/543 |
| 3,404,940 | 10/1968 | Chappuy | 431/264 |
| 3,406,002 | 10/1968 | Martin | 431/265 |
| 3,495,925 | 2/1970 | Willson | 431/80 |
| 3,729,288 | 4/1973 | Berlincourt et al. | 431/266 |
| 3,887,895 | 6/1975 | Pierzchala | 174/78 |
| 4,298,336 | 11/1981 | Riehl | 431/264 |
| 4,325,690 | 4/1982 | Hayes | 431/78 |
| 4,326,843 | 4/1982 | Smith | 431/264 |
| 4,466,789 | 8/1984 | Riehl | 431/264 |

FOREIGN PATENT DOCUMENTS

| | | | |
|---|---|---|---|
| 2250490 | 10/1972 | Fed. Rep. of Germany | 431/80 |

*Primary Examiner*—Carroll B. Dority, Jr.

*Attorney, Agent, or Firm*—Candor, Candor & Tassone

[57] ABSTRACT

A fuel control system having a burner provided with parts for issuing fuel therefrom and an electrical ignition probe for igniting the issuing fuel by forming a spark gap with a ground electrode and creating sparking thereacross, the system having an electrically insulating member disposed adjacent the burner and carrying the ignition probe and the ground electrode in a fixed relation relative to each other to define the spark gap therebetween whereby the ground electrode is separate from the burner.

10 Claims, 6 Drawing Figures

FUEL CONTROL SYSTEM HAVING AN ELECTRICAL IGNITION PROBE, PARTS THEREFOR AND METHODS OF MAKING THE SAME

CROSS REFERENCE TO RELATED APPLICATION

This application is a divisional patent application of its copending parent patent application, Serial No. 545,668, filed Oct. 26, 1983, now U.S. Pat. No. 4,466,789, which, in turn, is a continuation application of its copending parent patent application, Serial No. 318,025, filed Nov. 4, 1981, now abandoned.

BACKGROUND OF THE INVENTION

1. Field of the Invention

This invention relates to an improved fuel control system for a cooking apparatus or the like wherein an electrical ignition probe means is provided for causing direct ignition of the fuel issuing from a main burner of the system, this invention also relating to an electrical ignition probe unit for such a system or the like as well as to methods of making such a system and/or such an electrical ignition probe unit.

2. Prior Art Statement

It is known to provide a fuel control system having a burner means provided with port means for issuing fuel therefrom and an electrical ignition probe means for igniting the issuing fuel by forming a spark gap with a ground electrode means and creating sparking thereacross.

For example, see the following U.S. patent:

(1) U.S. Pat. No. 2,545,945 Ensign et al

It appears that the electrical ignition probe of the fuel control system of item (1) above forms a spark gap with the grounded structure of the burner itself to spark thereacross adjacent a port means of the burner to ignite the fuel issuing therefrom.

SUMMARY OF THE INVENTION

It is one feature of this invention to provide an improved fuel control system having a unique electrical ignition probe unit for igniting fuel issuing from a burner means of the system.

In particular, it was found according to the teachings of this invention that when the prior known electrical ignition probe means is mounted adjacent the burner means to define the spark gap with a grounded part of the burner means, it is difficult to always provide and maintain a reliable dimension for the resulting spark gap.

Therefore, it was found according to the teachings of this invention that a ground electrode means and an electrical ignition probe means could be carried by an electrically insulating member in a fixed relation relative to each other to define an accurately dimensioned spark gap therebetween.

For example, one embodiment of this invention provides a fuel control system having a burner means provided with port means for issuing fuel therefrom and an electrical ignition probe means for igniting the issuing fuel by forming a spark gap with a ground electrode means and creating sparking thereacross, the system having an electrically insulating means disposed adjacent the burner means and carrying the ignition probe means and the ground electrode means in a fixed relation relative to each other to define the spark gap therebetween whereby the ground electrode means is separate from the burner means.

Accordingly, it is an object of this invention to provide an improved fuel control system having one or more of the novel features of this invention as set forth above or hereinafter shown or described.

Another object of this invention is to provide an improved method of making such a fuel control system, the method of this invention having one or more of the novel features of this invention as set forth above or hereinafter shown or described.

Another object of this invention is to provide an improved electrical ignition probe unit for a fuel control system, the electrical ignition probe unit of this invention having one or more of the novel features of this invention as set forth above or hereinafter shown or described.

Another object of this invention is to provide an improved method of making such an electrical ignition probe unit, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
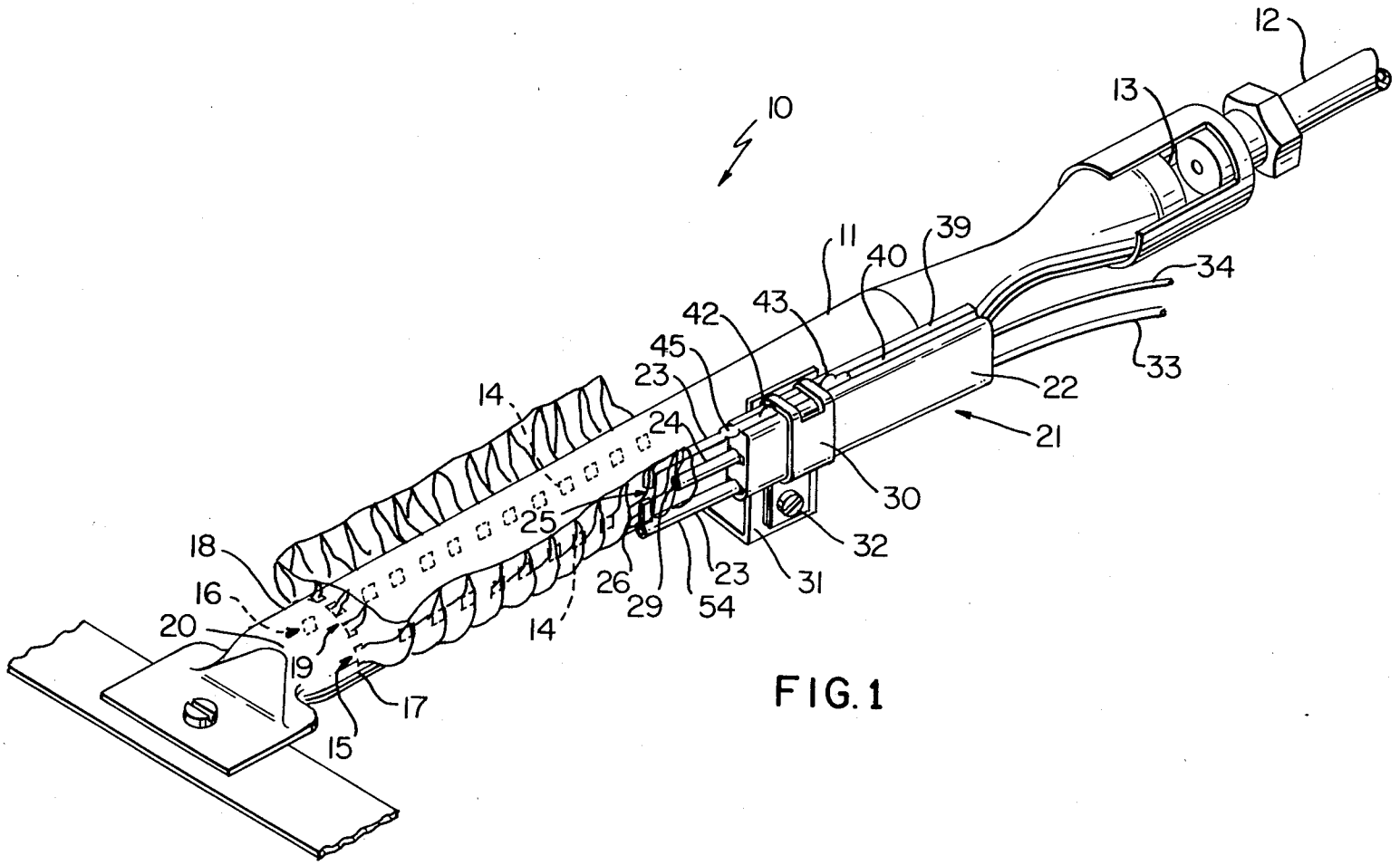
FIG. 1 is a fragmentary perspective view illustrating the improved fuel control system of this invention.
Figure 2:
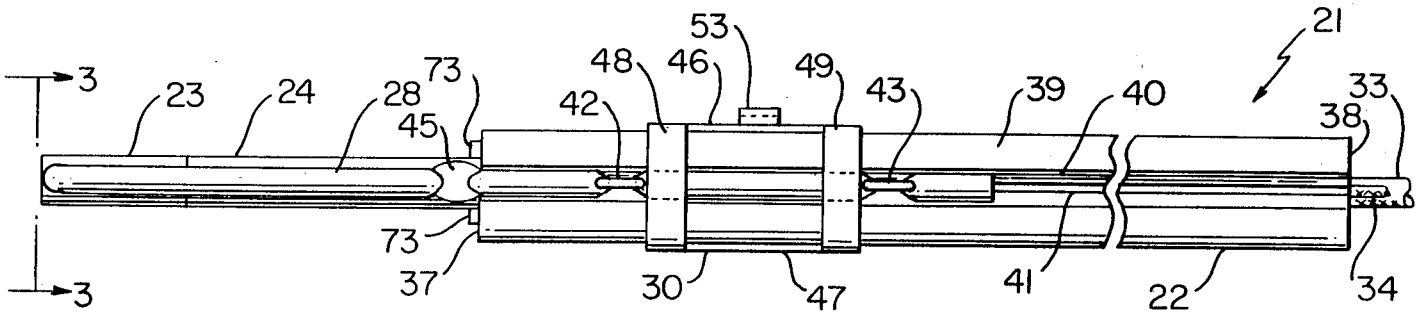
FIG. 2 is an enlarged fragmentary top view of the electrical ignition probe unit of the fuel control system of FIG. 1 and is taken substantially in the direction of the arrows 2—2 of FIG. 4.

While the various features of this invention are hereinafter described and illustrated as being particularly adapted to provide a fuel control system for a cooking apparatus, it is to be understood that the various features of this invention can be utilized singly or in any combination thereof to provide a fuel control system for other types of apparatus as desired.

Therefore, this invention is not to be limited to only the embodiment illustrated in the drawings, because the drawings are merely utilized to illustrate one of the wide variety of uses of this invention.

Referring now to FIG. 1, the improved fuel control system of this invention is generally indicated by the reference numeral 10 and includes a main burner means 11 for a cooking apparatus or the like adapted to receive fuel from a fuel source conduit 12 that is interconnected to an inlet 13 of the burner means 11 to issue out of a plurality of burner ports 14 arranged in a series of two rows 15 and 16 respectively on opposite sides 17 and 18 of the tubular burner means 11 and being, in effect, interconnected together for flame propagation purposes by a row 19 of burner ports 14 formed across the top 20 of the burner means 11.

While the burner means 11 can be formed of other configurations, the embodiment thereof illustrated in the drawings is fully illustrated and described in the U.S. Pat. No. 3,386,431 to Branson and such U.S. patent is being incorporated into this disclosure by reference thereto so that should further details of the burner means 11 be desired, reference can be made to such U.S. patent.

The fuel control system 10 of this invention includes an electrical ignition probe unit of this invention that is generally indicated by the reference numeral 21 in the drawings and comprises an electrically insulating one-piece member 22, formed of ceramic material or the like, carrying an electrical ignition probe means 23 and a ground electrode means 28 in fixed relation to each other to define a spark gap 25 between a sparking end 26 of the electrical ignition probe means 23 and a cooperating end 27 of the ground electrode means 28 in a manner hereinafter set forth.

In addition, the electrical ignition probe unit 21 includes a proof-of-flame electrode means 24 also carried by the insulating member 22 in such a manner that its end 29 is disposed spaced from the spark gap 25 a sufficient distance so that sparking to the probe end 29 of the proof-of-flame electrode means 24 cannot take place.

The electrical ignition probe unit 21 of this invention also includes a conductive metallic strap or clip 30 that not only clamps the ground electrode means 28 to the insulating body 22 in a manner hereinafter set forth, but also the clamp 30, by being fastened to a grounded bracket means 31 of the fuel control system 10 by a fastening means 32, electrically interconnects the ground electrode means 28 to a ground potential.

In this manner when a suitable electrical potential is interconnected to the lead end 33 of the electrical ignition probe means 23 in a manner well known in the art, sparking can take place across the spark gap 25 between the sparking end 26 of the electrical ignition probe means 23 and the end 27 of the ground electrode means 28 so that such sparking will ignite the fuel issuing from the port means 14 of the burner means 11 adjacent the spark gap 25. Thus, upon initial ignition of the fuel issuing from the burner ports 14 adjacent the electrical ignition probe unit 21 of this invention, sufficient flame propagation will take place completely down the row 15 of ports 14 and across the top row 19 of ports 14 to the row 16 to extend down the row 16 in a manner well known in the art.

The flames now existing from the burner ports 14 of the burner means 11 is detected by the proof-of-flame electrode means 24 so that the proof-of-flame electrode means 24, through its lead means 34, can control a suitable unit (not shown) to permit the fuel to continue to be directed by the fuel source conduit 12 to the burner means 11 as long as flames exist at the ports 14 of the burner means 11. However, if after a sufficient sparking time at the spark gap 25 of the unit 21, the proof-of-flame electrode means 24 will terminate the flow of fuel from the source conduit 12 into the burner means 11 in a manner well known in the art if sufficient flames do not exist.

The insulating member 22 of this invention can be formed by extruding insulating material in the configuration illustrated in the drawings and thereafter merely cutting the extruded material in the desired lengths for forming the electrically insulating members 22 of this invention whereby it can be seen that the overall cost of making the insulating members 22 is held to absolute minimum.

The insulating member 22 is provided with a pair of opening means 35 and 36 passing in spaced parallel relation through the opposed ends 37 and 38 of the member 22 and respectively receiving part of the electrical ignition probe means 23 and proof-of-flame electrode means 24 therein in a manner hereinafter set forth whereby it can be seen that each opening means 35 and 36 has a substantially uniform circular transverse cross-sectional configuration throughout the entire length thereof so that the member 22 can be readily extruded, if desired, and does not require expensive counterboring to form stepped shoulders therein as will be apparent hereinafter.

In addition, the top surface 39 of the insulating member 22 is provided with an extruded groove 40 extending throughout the entire length thereof with the groove 40 having a smaller groove 41 formed throughout the length thereof in the bottom of the groove 40 for a purpose hereinafter described.

Figure 4:
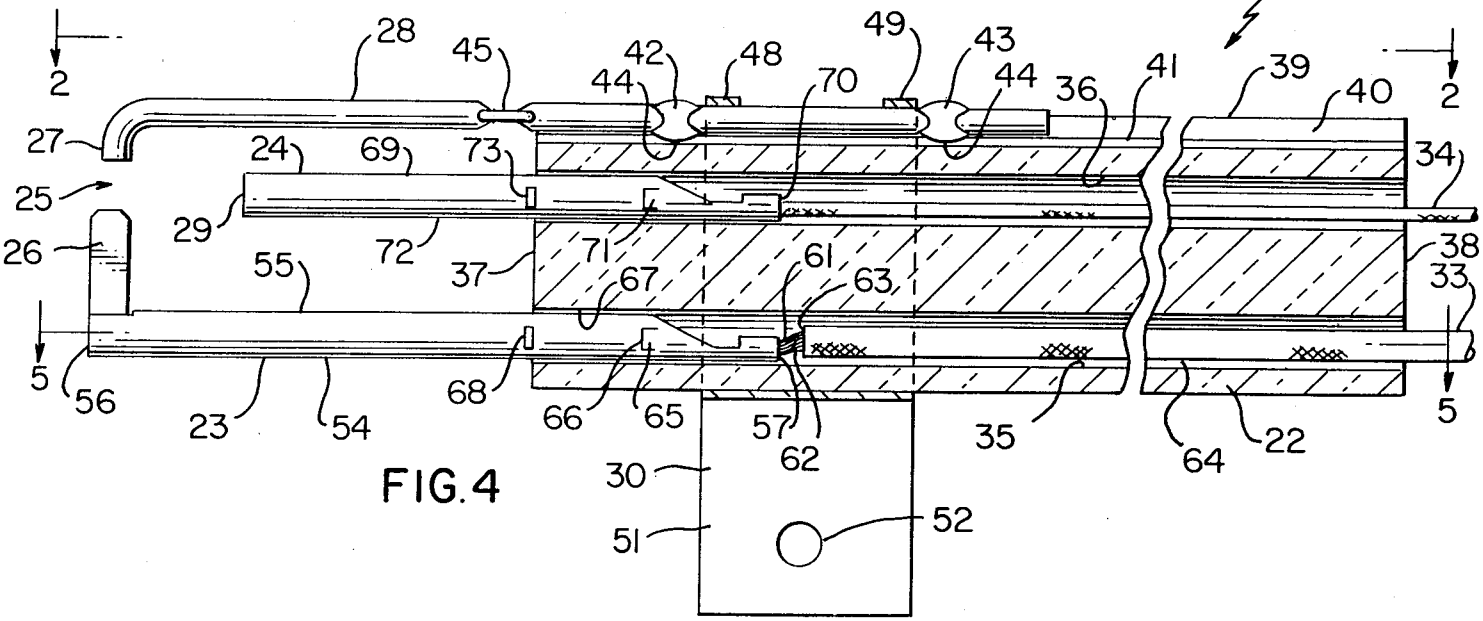
FIG. 4 is a cross-sectional view taken on line 4—4 of FIG. 3.

The ground electrode means 28 comprises a cylindrical length or rod of metal that has its end 27 turned at a right angle thereto and has a pair of flattened sections 42 and 43 formed in spaced relation and in a like direction so that the flattened areas 42 and 43 will have the lower edges 44 thereof adapted to be received in the small groove 41 while the body portion of the electrode means 28 is received in the larger groove 40 as illustrated in FIG. 4 to prevent rotation of the electrode means 28 relative to the member 22 when the ground electrode means 28 is clamped thereto by the strap means 30 in a manner hereinafter set forth. In this manner, the flattened areas 42 and 43 properly orient the bent end 27 of the probe means 28 so as to extend vertically downwardly toward the sparking end 26 of the electrical ignition probe means 23 which extends vertically upwardly as illustrated to form the spark gap 25 of the proper dimension therebetween.

A third flattened area or section 45 is formed on the ground electrode means 28 at right angles to the flattened areas 42 and 43 so as to abut against the end 37 of the member 22 to properly position the end 27 at a predetermined distance from the end 37 of the member 22 so that the bent end 27 will be vertically aligned with the sparking end 26 of the electrical ignition probe means 23.

Figure 3:
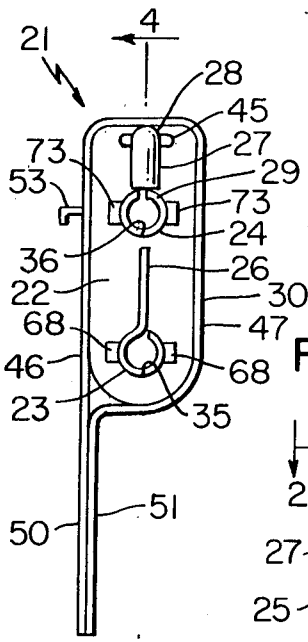
FIG. 3 is an end view of the electrical ignition probe unit of FIG. 2 and is taken in the direction of the arrows 3—3 of FIG. 2.

The fastening strap or clip 30 comprises a one-piece metallic member bent into two sections 46 and 47 as illustrated in FIG. 3 and being integrally joined together at the upper ends by a pair of spaced apart arms or strap portions 48 and 49 that hinge the sections 46 and 47 together and respectively are spaced to be disposed inboard but adjacent the flattened areas 42 and 43 of the ground electrode means 28 when the same is properly positioned in the groove 40 by having the flattened portion 45 thereof disposed against the end 37 of the insulating member 22. When the lower portions 50 and 51 of the sections 46 and 47 of the strap 30 are brought against each other as illustrated in FIG. 3 so as to have the aligned openings 52 therein receive the fastening member 32 to fasten the same to the mounting bracket 31, the portions 46 and 47 and arms 48 and 49 tightly grip against the external peripheral surface of the insulating member 22 and the ground electrode member 28 so that the arms 48 and 49 firmly hold the ground electrode means 28 in the proper position in the grooves 40 and 41 whereby movement between the ground electrode means 28 and the insulating member 22 cannot take place, the arms 48 and 49 preventing axial movement of the ground electrode means 28 in the grooves 40 and 41 so that the bent end 27 thereof will be properly positioned relative to the sparking end 26 of the electrical ignition probe means 23 to accurately define the spark gap 25 therebetween.

If desired, the mounting strap 30 can be provided with a locating and locking tang 53 carved from the section 46 thereof to interlock in a suitable opening (not shown) in the bracket 31 so as to cooperate with the fastening member 32 to properly position the unit 21 relative to the burner means 11 whereby the spark gap 25 will be properly positioned relative to the ports 14 of the burner means 11 for proper ignition purposes therewith.

The details of the electrical ignition probe means 23 of this invention and the method of this invention for making such electrical ignition probe means 23 will now be described and reference is made to FIGS. 2–6 wherein it can be seen that the electrical ignition probe means 23 of this invention is formed from an electrode 54, an ignition wire 33 and the rigid electrically insulating body 22.

One of the reasons why the electrical insulating body 22 of this invention can have the bore means 35 with a uniform cross section throughout the entire length thereof is because of the unique electrode 54 of this invention which through its particular structure will prevent the electrode 54 from being removed from the opening 35 of the body 22 after the same has been assembled therein in a manner hereinafter set forth without requiring a stepped shoulder arrangement in the ceramic body 22 as in prior known structure.

In particular, the electrode 54 of this invention comprises a one-piece stamped metallic member which has a substantially tubular body portion 55 provided with opposed ends 56 and 57, the sparking end 26 of the electrode 54 being integral with the body portion 55 and extending substantially transversely to the end 56 thereof so as to position the sparking end 26 vertically above the body portion 55.

Figure 5:
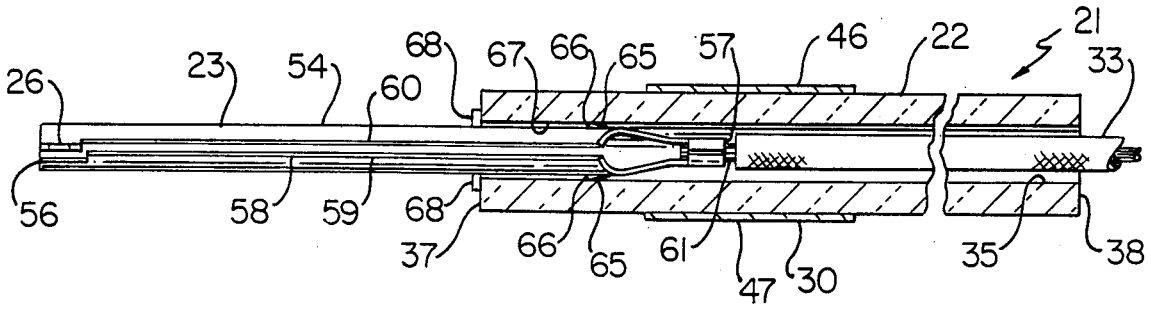
FIG. 5 is a fragmentary cross-sectional view taken on line 5—5 of FIG. 4.
Figure 6:
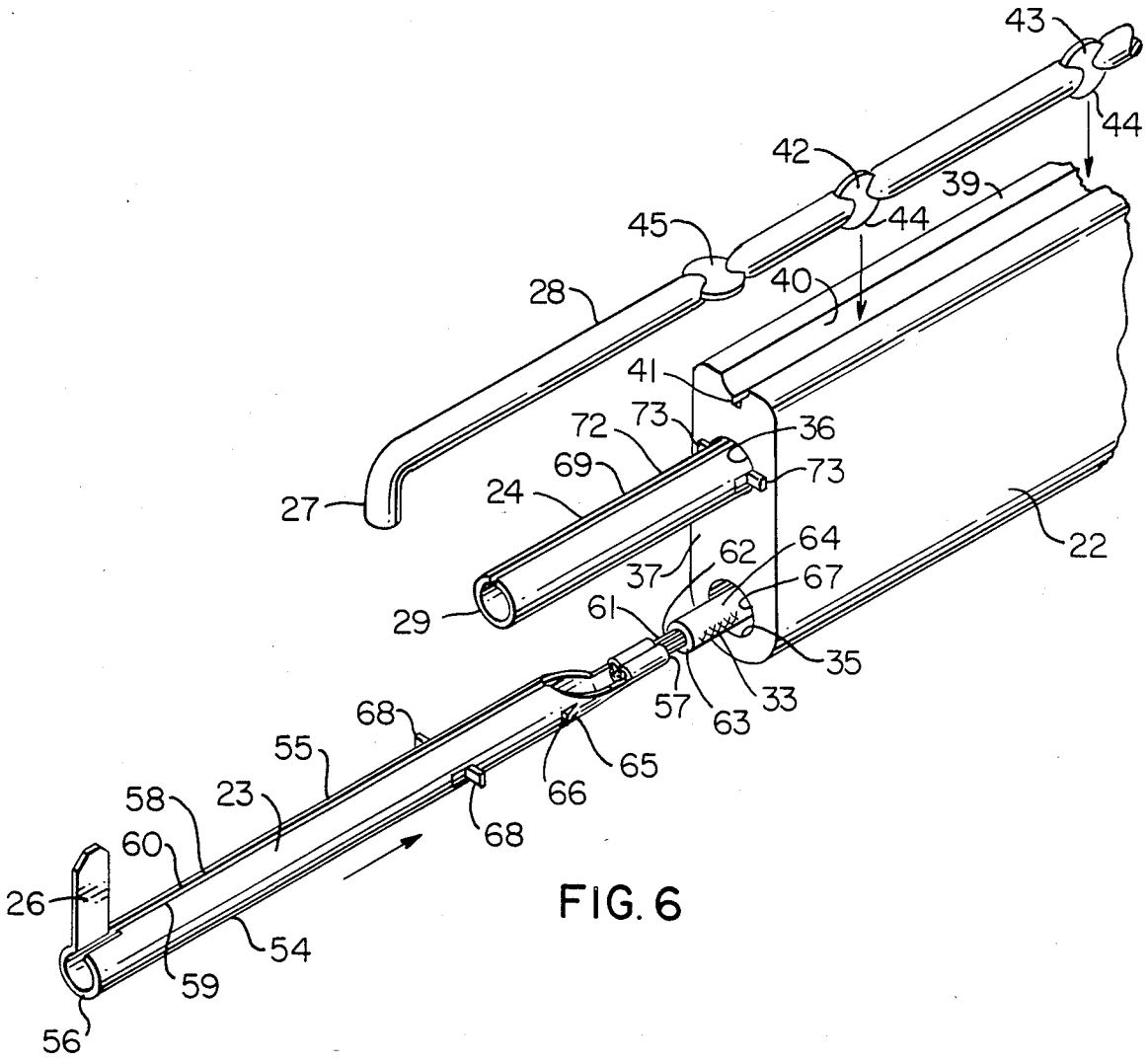
FIG. 6 is an exploded fragmentary perspective view illustrating one of the steps of the method of this invention for making the electrical ignition probe means of this invention.

Because the electrode 54 comprises a one-piece member cut and stamped from a flat sheet of stock material into the configuration illustrated in FIGS. 5 and 6, it can be seen that, in effect, a slot means 58 extends between the opposed ends 56 and 57 thereof and thereby defines opposed edge means 59 and 60 throughout the length of the body portion 55. In this manner, the sparking end 26 of the electrode 54 is integral with the edge 60 and extends vertically from the same as illustrated in a manner to substantially bisect the tubular body portion 55.

Because of the slot means 58, the tubular end 57 of the body portion 55 is adapted to telescopically receive a bared end 61 of the ignition wire 33 therein in a manner illustrated in FIG. 6 and then be crimped inwardly around the end 61 as illustrated in FIG. 6 to securely secure the ignition wire 33 to the end 57 of the electrode 54.

While the ignition wire 33 can be formed of any suitable material, it has been found that the same can comprise size No. 18 tinned copper wire 62 coated with a silicone rubber 63 and covered with a fray resistant glass braided jacket 64, the length of the ignition wire 33 being of any desired length within suitable limits.

The electrode 54 has a pair of integral tangs or ears 65 formed on opposite sides of the tubular body portion 55 and intermediate the ends 56 and 57 thereof, the ears 65 having sharp free edges 66 which are adapted to engage and dig into the internal peripheral surface 67 of the ceramic body 22 when the electrode 54 is disposed within the opening or bore 35 in the manner illustrated in FIGS. 4 and 5.

In this manner, the ears 65 of the electrode 54 tend to prevent relative movement of the electrode 54 relative to the body 22 after the same has been assembled therein in a manner hereinafter set forth.

Also, a pair of opposed stop tangs 68 are carved from the opposed sides of the tubular body 55 of the electrode 54 for a purpose hereinafter described.

Therefore, it can be seen that the parts for forming the electrical ignition probe means 23 of this invention can be formed in a relatively simple manner to form the electrical ignition probe means 23 by the method of this invention in a manner now to be described.

When it is desired to assemble an electrode 54 of this invention to the end 61 of the ignition wire 33, the ceramic body 22 can be telescoped onto the ignition wire 33 so that the end 61 of the ignition wire 33 extends beyond the end 37 thereof in a manner illustrated in FIG. 6 or the body 22 can be disposed on the ignition wire 33 after the electrode 54 has been secured to the end 61 of the ignition wire 33 as desired.

In any event, the insulation 63 and 64 of the ignition wire 33 is removed from one end of the wire 62 to expose the bared end 61 thereof so that the end 61 can be telescoped into the tubular end 57 of the body portion 55 of the electrode 54 and be secured therein by having the end 57 crimped inwardly around the end 61 of the ignition wire 33 in the manner illustrated in FIG. 6 to securely fasten the end 57 of the electrode 54 to the end 61 of the ignition wire 33.

Thereafter, the rigid electrically insulating body 22 and the electrode 54 are telescoped together so that the body portion 55 of the electrode 54 is received in the opening or bore means 35 of the body 22 and the electrode 54, such as by pulling on the right-hand end of the ignition wire 33 and/or by pushing on the electrode 54 to force the same into the opening 35 of the body 22 at the end 37 thereof. Such telescoping movement is continued until the stop tangs 68 of the electrode 54 abut against the end 37 of the ceramic body 22 in the manner illustrated in FIGS. 2 and 5 whereby the electrode 54 is firmly secured in the rigid body 22 and the rigid body 22 fully electrically insulates the spliced connection between the end 57 of the electrode 54 and the end 61 of the ignition wire 33. In particular, the electrode 54 not only cannot be readily pulled out of the opening 35 because of the ends 66 of the tabs 65 biting into the internal peripheral surface 67 of the body 22 to resist such outward movement, but also rotational movement between the electrode 54 and the body 22 is prevented by the tabs 65. Obviously, pulling outwardly to the right on the electrode wire 33 is resisted by the stop tangs 68 of the electrode 54 abutting the end 37 of the body 22.

In this manner it can be seen that the stop tangs 68 properly position the sparking end 26 of the electrode 54 from the end 37 of the insulating body 22 so that the sparking end 26 is vertically aligned with the bent end 27 of the ground electrode means 28 to accurately define the spark gap 25 of the proper dimension.

Because the electrode 54 has the slot means 58 extending along the same, a roll pin effect is provided by the electrode 54 as the same is being inserted into the opening 35 of the insulating body 22 because the crimped end 57 is sufficiently smaller than the diameter of the opening 35 so that the same can readily be inserted therein and as the electrode 54 is further pushed into the opening 35, the groove 58 can be narrowed by the cooperating sides of the body portion 55 being squeezed together so that there is sufficient resilient outward force on the ends 66 of the tangs 65 to properly grip into the internal peripheral surface 67 of the insulating body 22 to hold the electrode 54 in its fully inserted and telescoped condition with the stop tangs 68 against the end 37 of the body 22.

The electrical ignition probe means 23 previously described is similar to an electrical ignition probe means of applicant's copending patent application, Ser. No. 241,202 filed Mar. 6, 1981, now U.S. Pat. No. 4,431,240, and such application is incorporated into this application by this reference thereto.

The proof-of-flame electrode means 24 is formed in substantially the same manner as the electrical ignition probe means 23 except that the same has its tubular end 29 without a sparking tang or end 26 extending therefrom. However, it can be seen that the proof-of-flame electrode means 24 comprises an electrode 69 formed in substantially the same manner as the electrode 54 so that an end 70 of the electrode 69 is secured to a bared end of the wire 34 and is held in the opening 36 by tangs 71 of the tubular body 72 of the electrode 69 in the same manner as the tanges 65 of the electrode 54. In addition, the tubular body 72 of the electrode 69 has stop tangs 73 which engage against the end 37 of the insulating body 22 to properly position the end 29 of the electrode 69 from the spark gap 25 so that sparking from the sparking end 26 of the electrical ignition probe means 23 will not take place against the end 29 of the proof-of-flame electrode means 24 and will be directed to the end 27 of the ground electrode means 28.

Therefore, it can be seen that the electrode means 24 can be readily assembled to the insulating body 22 in the same manner as the electrical ignition probe means 23 previously described.

Thus, the electrical ignition probe unit 21 of this invention can be formed in a relatively simple and effective manner by the previously described method of this invention to accurately provide the spark gap 25 for subsequent sparking adjacent the port means 14 of the burner means 11 after the unit 21 has been fastened to the bracket 31 in the manner previously described.

While the electrical ignition probe unit 21 is illustrated as being mounted on one side of the burner 11, it is to be understood that the unit 21 could be mounted on the other side of the burner 11 and the clamp 30 of this invention readily permits such change by a simple reversal of the clamp 30 on the body 22.

Therefore, it can be seen that this invention not only provides an improved fuel control system and method of making the same, but also this invention provides an improved electrical ignition probe unit and method of making the same.

While the forms and methods of this invention now preferred have been illustrated and described as required by the Patent Statute, it is to be understood that other forms and method steps can be utilized and still fall within the scope of the appended claims.

What is claimed is:

1. In a method of making a fuel control system having a burner means provided with port means for issuing fuel therefrom, an electrical ignition probe means for igniting said issuing fuel by forming a spark gap with a ground electrode means and creating sparking thereacross, an electrically insulating means disposed adjacent said burner means and carrying said ignition probe means and said ground electrode means in a fixed relation relative to each other to define said spark gap therebetween whereby said ground electrode means is separate from said burner means, and a support bracket carrying said insulating means so that said spark gap is fixed relative to said burner means, the improvement comprising the step of clamping said ground electrode to said insulating means with a clamping means that secures said insulating means to said support bracket.

2. A method of making a fuel control system as set forth in claim 1 and including the step of forming said electrically insulating means to comprise a one-piece member.

3. A method of making a fuel control system as set forth in claim 2 and including the steps of forming said member with an opening passing therethrough, and telescopically disposing part of said ignition probe means in said opening so that a sparking end of said ignition probe means is disposed beyond one end of said member.

4. A method of making a fuel control system as set forth in claim 3 and including the step of forming an end of said ground electrode means to be disposed beyond said one end of said member and cooperate with said sparking end of said ignition probe means to define said spark gap therebetween.

5. A method of making a fuel control system as set forth in claim 4 and including the steps of forming said ground electrode to have locating means thereon, and forming said member to have locating means operatively associated with said locating means of said ground electrode to position said ground electrode thereon.

6. A method of making a fuel control system as set forth in claim 5 and including the step of forming said clamping means to comprise an electrically conductive means electrically connecting said ground electrode to a ground potential through said bracket.

7. A method of making a fuel control system as set forth in claim 3 and including the step of securing a proof of flame electrode means to said member in spaced relation to said spark gap.

8. A method of making a fuel control system as set forth in claim 7 and including the steps of forming said member with another opening passing therethrough, and telescopically disposing part of said proof of flame electrode means in said other opening so that an end of said proof of flame electrode means is disposed beyond said one end of said member and intermediate said one end of said member and said sparking end of said ignition probe means.

9. A method of making a fuel control system as set forth in claim 8 and including the step of forming said openings of said member to each be substantially uniform in cross section throughout its entire length.

10. A method of making a fuel control system as set forth in claim 5 and including the step of forming said clamping means to cooperate with said locating means of said ground electrode means to tend to prevent axial movement of said ground electrode means relative to said member.

* * * * *